US010327503B2

(12) United States Patent
Frey

(10) Patent No.: US 10,327,503 B2
(45) Date of Patent: Jun. 25, 2019

(54) SHOE INSERT

(71) Applicant: Mark Frey, Pound Ridge, NY (US)

(72) Inventor: Mark Frey, Pound Ridge, NY (US)

( * ) Notice: Subject to any disclaimer, the term of this patent is extended or adjusted under 35 U.S.C. 154(b) by 2 days.

(21) Appl. No.: 15/486,761

(22) Filed: Apr. 13, 2017

(65) Prior Publication Data

US 2017/0295883 A1 Oct. 19, 2017

Related U.S. Application Data

(60) Provisional application No. 62/450,331, filed on Jan. 25, 2017, provisional application No. 62/322,274, filed on Apr. 14, 2016.

(51) Int. Cl.
*A43B 17/00* (2006.01)
*A43B 7/14* (2006.01)

(52) U.S. Cl.
CPC ..... *A43B 7/1445* (2013.01); *A43B 7/145* (2013.01); *A43B 7/148* (2013.01); *A43B 17/00* (2013.01)

(58) Field of Classification Search
CPC ..... A43B 7/1445; A43B 7/145; A43B 7/1455; A43B 7/146; A43B 7/1465; A43B 7/148; A43B 7/1485; A43B 7/149; A43B 7/26; A43B 17/00
USPC ..... 36/43, 44, 140, 141
See application file for complete search history.

(56) References Cited

U.S. PATENT DOCUMENTS 736,194 A * 8/1903 Bassett ..... A43B 3/126 36/11.5
1,741,419 A * 12/1929 Jones ..... A43B 7/14 36/145
2,088,902 A * 8/1937 Fein ..... A43B 17/00 36/28
5,551,173 A * 9/1996 Chambers ..... A43B 7/146 36/141
5,768,803 A * 6/1998 Levy ..... A43B 7/1425 36/140
5,976,100 A * 11/1999 Greenawalt ..... A43B 1/0054 36/43
6,061,929 A * 5/2000 Ritter ..... A43B 3/0052 36/107
6,990,756 B1 * 1/2006 Johnson ..... A43B 7/142 36/155

(Continued)

OTHER PUBLICATIONS

Dynamic Biomechanics of the Normal Foot and Ankle During Walking and Running, Mary M. Rodgers, Physical Therapy, vol. 68, No. 12, Dec. 1988, pp. 1822-1830.

*Primary Examiner* — Ted Kavanaugh

(57) ABSTRACT

A shoe insert includes a generally planar body having a perimeter defining a foot-shaped area on an upper side of the body, the foot-shaped area including first and second toe areas and a heel area configured respectively for placement of a first toe, a second toe, and a heel of a user. The upper side defines a channel extending along an axis passing through a space between the first and second toe areas and the heel area. A linear member may be placed in the channel to protrude from an upper surface of the body. When a user uses the insert, the user's foot may sense the channel (or linear member, if present) and activate mechano-receptors on the bottom of the foot along the channel, which, in-turn, may train the foot to extend in a predetermined position relative to the linear member to improve balance.

9 Claims, 3 Drawing Sheets

(56) References Cited

U.S. PATENT DOCUMENTS

| | | | | |
|---|---|---|---|---|
| 2005/0066544 | A1* | 3/2005 | Beak | A41B 11/008 36/43 |
| 2005/0229430 | A1* | 10/2005 | Takaba | A43B 3/102 36/11.5 |
| 2006/0236564 | A1* | 10/2006 | Allard | A61F 5/14 36/140 |
| 2011/0061262 | A1* | 3/2011 | Krauss | A43B 7/26 36/11.5 |
| 2013/0160331 | A1* | 6/2013 | Burke | A43B 1/0081 36/25 R |
| 2015/0075030 | A1* | 3/2015 | Walborn | A43B 1/0009 36/44 |
| 2015/0237954 | A1* | 8/2015 | Chen | A43B 7/26 36/43 |

* cited by examiner

SHOE INSERT

CROSS-REFERENCE TO RELATED APPLICATIONS

This application claims benefit of U.S. Provisional Patent Application Nos. 62/322,274, filed on Apr. 14, 2016, and 62/450,331, filed Jan. 25, 2017, the entire contents of which are incorporated herein by reference.

BACKGROUND

1. Field

This disclosure relates to shoe inserts and orthotics.

2. State of the Art

Some people, as they age or recover from injury or surgery, may tend to lose their balance and/or walk with a slower, wider gait, moving side-to-side off of the outside of their feet, causing dysfunction and potentially injurious movement. The ability to balance ourselves on our feet acts as a precursor to movement.

SUMMARY

In accordance with a first aspect, further details of which are described herein, a shoe insert includes a generally planar body having a perimeter defining an at least partially foot-shaped area that includes first and second toe areas and a heel area configured respectively for placement at or adjacent of first and second toes and a heel of a user. The body has an upper side defining a sensory feedback structure extending along a gravitational stress line (GSL) extending along an axis defined by a space between the first and second toe areas and the heel area. The body may define a hole in the heel area, and the insert may further include a heel insert configured for insertion in the hole. The heel insert may be configured for heel spur or plantar fasciitis therapy.

The sensory feedback structure may include a channel. The channel may extend from the space between the first and second toe areas to a midsole area. The sensory feedback structure may further include an elongated member disposed in the channel and protruding above a surface of the upper side of the body. The elongated member may be resilient and compressible. The channel is defined by a width and a depth and the elongated member is defined by an uncompressed width and depth, and the uncompressed width and depth of the elongated member may preferably be larger than the width and depth of the channel. The elongated member may be removably coupled to the body, which may permit interchanging different elongated members having different compression and resilience to achieve a desired therapeutic effect.

The channel and/or the elongated member can be used to train a user's gait to improve balance. Specifically, the bottom of a user's foot has mechano-receptors which, when contacted, can trigger a sensory response that can be processed in the user's brain to facilitate locomotion, and, more particularly, balance. When a user uses the insert (i.e., wears shoes having the insert in the shoe), the user's foot may sense the open channel (if the elongated member is absent) or the elongated member (if present in the channel) and activate mechano-receptors on the bottom of the foot along the channel, which, in-turn, facilitate training the foot to extend in a predetermined position relative to the channel to promote balance during walking.

In accordance with a second aspect, further details of which are provided herein, a shoe insert may include a generally planar or contoured body having a perimeter defining an at least partially foot-shaped area that includes first and second toe areas and a heel area configured respectively for placement of first and second toes thereat or thereadjacent and a heel of a user. The upper side defines a first channel extending along a gravitational stress line extending along a first axis defined from a space between the first and second toe areas and the heel area, and defines a second channel located laterally of the gravitational stress line.

The second channel may extend along a second axis that intersects with the first axis, and the second channel may extend at an angle between 1 and 15 degrees relative to the first channel. The first and second channels may extend distally from a midsole area. For example, the first channel may extend from the space between the first and second toe areas to the midsole area, and the second channel may extend from a third toe area to the midsole area. The insert may also include a first elongated member disposed in the first channel and protruding above a surface of the upper side of the body, and may include a second elongated member disposed in the second channel and protruding above the surface of the upper side of the body. The first elongated member and the second elongated member are preferably resilient and compressible as well as removably coupled to the body.

According to yet another aspect, further details of which are described herein, a shoe insert kit includes a planar or contoured body having a perimeter defining a foot-shaped area including a plurality of toe areas and a heel area configured respectively for placement of a plurality of toes and a heel of a user. The body may include an upper surface contour that provides orthotic support to a user's foot, including, e.g., arch support. The upper side includes at least one channel extending at an acute angle relative to a central longitudinal axis extending from a proximal end of the body at the heel area to a distal end of the body at the toe areas. The kit also includes one or more elongated members configured for insertion in the one or more channels. At least one channel may extend along a gravitational stress line defined by an axis from a space between a first toe area and a second toe area to the heel area. The body may define a hole in the heel area, and the kit may further include at least one heel insert configured for insertion in the hole.

DETAILED DESCRIPTION

Figure 1:
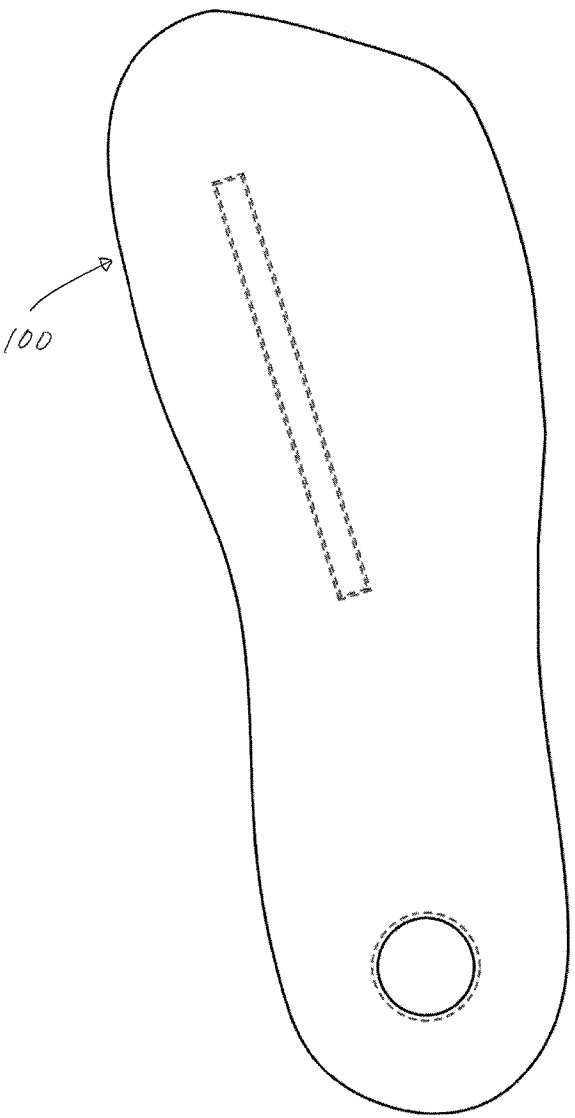
FIG. 1 shows a top elevation view of a pair of shoe inserts in accordance with an embodiment of the disclosure.
Figure 1:
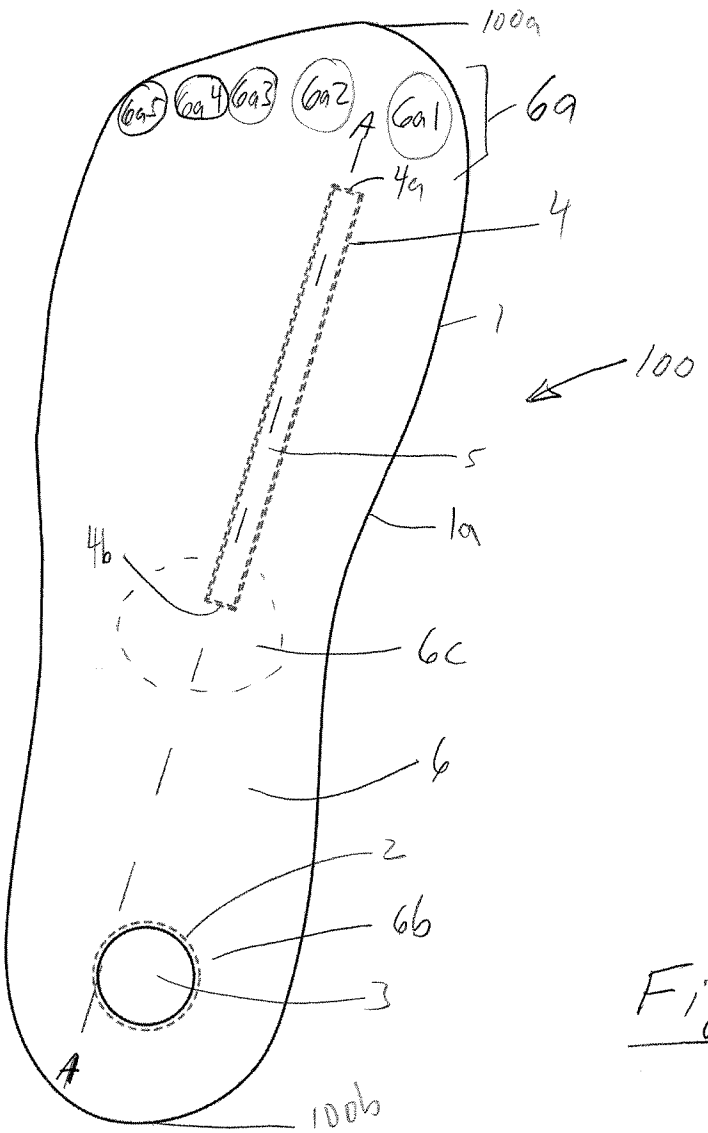

FIG. 1 illustrates a pair of shoe inserts 100 in accordance with an aspect of the disclosure. Shoe inserts may be provided in pairs for use in pairs of shoes. Each of the pair of shoe inserts preferably has mirror symmetry to correspond to the left and right feet. The inserts 100 include a body 1 defined by a perimeter 1*a* that surrounds a foot-shaped area 6 on an upper side of the body 1. The body 1 is generally planar, but may have an upper surface on the upper side that is at least partly contoured to conform to a user's foot or provide an advantageous orthotic support including, e.g., arch support. Also, the body 1 has a lower surface (not shown) on a lower side (not shown) that may be at least partly contoured to conform to an interior foot bearing surface of a user's shoe. The insert 100 extends from a distal end 100*a* to a proximal end 100*b*. The insert 100 is configured for placement in a user's shoe (not shown), either over or in place of the insole in the shoe. When used by a user, the user's heel is located on and toward the proximal end 100*b* of the insert 100 and the user's toes are located on and toward the distal end 100*a* of the insert 100, and preferably thereon. Optionally, the insert 100 may be sized or shaped such that the user's toes extend off of the distal end 100*a* of the insert 100.

In one preferred embodiment, the foot-shaped area 6 of the body 1 includes a plurality (five areas are shown) of toe areas 6*a*, a heel area 6*b*, and a mid-sole area 6*c*. The toe and heel areas 6*a* and 6*b* are configured, respectively, for placement of a user's toes and heel. The mid-sole area 6*c* is located about mid-way between the proximal end 100*b* and the distal end 100*a* of the insert 100.

Figure 2:
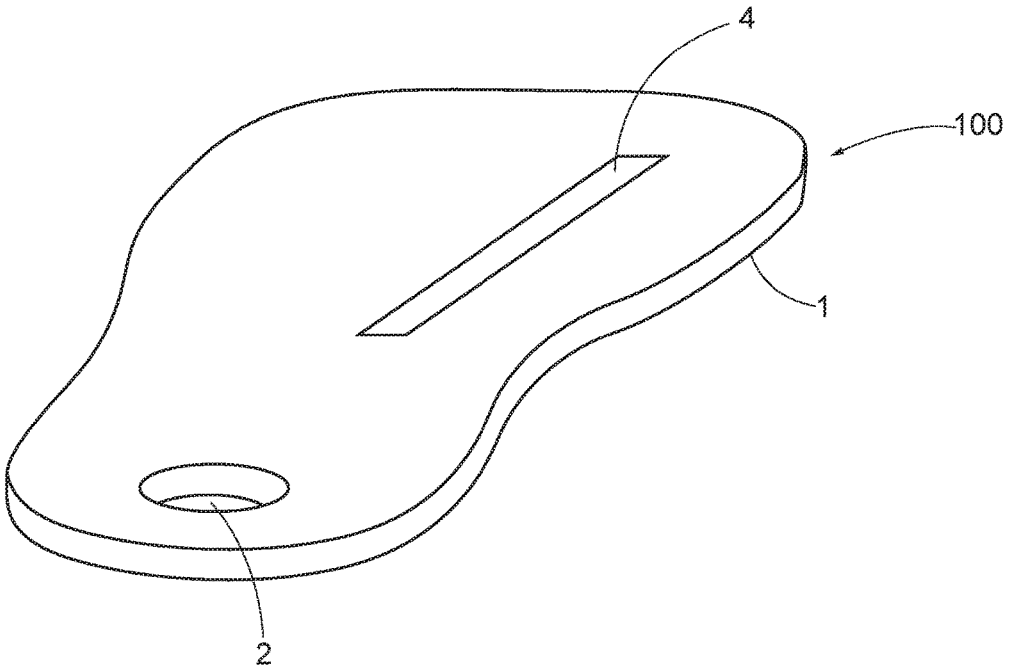
FIG. 2 is a perspective view of the left shoe insert shown in FIG. 1.

The body 1 may define a through-hole 2 in the heel area 6*c* of the insert 100. The hole 2 may be used to locate the user's heel over the hole 2 for desired positioning of the foot relative to the user's shoe. The hole may have a diameter of ½" to 3". The hole 2 may be configured to receive a heel insert 3, which may be specifically configured for alleviation of symptoms of heel spurs and/or plantar fasciitis, for example. The heel insert 3 may fully (as shown in FIGS. 1 and 2) or partially fill in the hole 2. In the example shown in FIG. 1, the hole 2 and the heel insert 3 are both circular, but in at least one alternate embodiment, the heel insert 3 may be less than a fully circle, or provided in a different shape.

The heel insert 3 may be removable and replaceable and interchangeable with a plurality of different heel inserts. The heel insert 3 may be formed of a material that is different from the body 1. For example, the body 1 may be formed of rubber and/or polymer gel and the heel insert 3 may be formed of rubber and/or polymer gel. Also, the body 1 and the heel insert 3 may have different physical properties, including density and durometer to achieve a desired therapeutic effect.

The body 1 defines a continuous elongated channel 4 recessed in the upper side of the body 1. The channel 4 extends proximally from an area between a first toe area 6*a*1 and a second toe area 6*a*2. In one embodiment, the channel 4 extends to about the midsole area 6*c*. The channel 4 is linear and preferably straight, but may be curvilinear. In the embodiment shown in FIGS. 1 and 2, the channel 4 extends along a straight line that defines a gravitational stress line (GSL) that extends from a first end 4*a* (roughly between the first and second toe areas 6*a*1 and 6*a*2) to a second end 4*b* at the midsole area 6*c*. The channel 4 extends along an axis A-A that lies medially of a center of the hole 2. The channel 4 may have a depth between 1/16 inch and 1.5 inch, and may have a width between 1 mm and 1.5 cm.

The channel 4 can be used to train a user's gait to improve balance. Specifically, the bottom of a user's foot has mechano-receptors which, when contacted, can trigger a sensory response that can be processed in the user's brain to facilitate locomotion, and, more particularly, balance. When a user uses the insert 100 (i.e., wears a shoe having an insert 100 in the shoe), the user's foot may sense the open channel 4 and activate mechano-receptors on the bottom of the foot along the channel 4, which, in-turn, may facilitate training the foot to extend in a predetermined position relative to the linear member to promote a user's body to improve balance.

The channel 4 may be configured to receive an optional linear member 5, as shown in FIGS. 1 and 2. The linear member 5 may be removable from the body 1 so that the insert 1 may be used with or without the linear member 5. The linear member 5 may be included with the body 1 as a kit, which may be configured and reconfigured (e.g., assembled or disassembled) for use as a shoe insert 100 by a user. The linear member 5 may be straight or curvilinear to conform to the linearity of the channel 4. The linear member 5 may have various cross sectional shapes, including a rectangular, square, or circular cross section, the latter circular shape being shown in FIG. 2. The linear member 5 may be dimensioned so that when it is positioned in the channel 4 and is not subject to pressure from the user's foot, a portion of the linear member 5 will extend upward (i.e., will be raised or protrude) with respect to the surface of the upper side of the body 1, as shown in FIG. 2. The vertical distance that the linear member 5 protrudes from the surface of the top side may depend on the dimensions of the linear member 5 and the channel 4. For example, in one embodiment, the cross sectional diameter of the linear member 5 may be larger than the vertical depth of the channel 4 so that the linear member 5 will protrude from the surface of the top side of the body 1 even when the linear member 5 is in contact with the bottom of the channel 4. Also, by way of example, the cross sectional diameter of the linear member 5 shown in FIG. 2 may be at least equal to the width of the channel 4 so that the linear member 5 fits snugly against the side walls of the channel 4.

The linear member 5 may be formed of a resilient and compressible material so that it can compress when pressure is applied to it by a user's foot, and can expand when pressure is reduced (such as when a user lifts his or her foot from the floor while walking). Examples of materials comprising the linear member 5 include rubber, plastic, polymer, Poron™, petroleum base, any and all synthetics suitable to achieve the function of the linear member 5. Owing to the resilience of the linear member 5, when the linear member 5 is compressed it exerts outward restoring forces against the surface compressing (i.e., the user's foot). Thus, the linear member 5 may be configured to continuously urge itself into contact with the bottom of a user's foot in the shoe, even when the linear member 5 is partly or fully compressed. Such contact between the linear member 5 and the user's foot activate the mechano-receptors on the bottom of the foot along the linear member 5, which, in-turn, facilitate training the foot to extend in a predetermined position relative to the linear member to promote a user's body to improve balance.

In an alternate embodiment of the insert 100, instead of the linear member 5 and the channel 4, the body 1 has a sensory feedback structure formed as a raised ridge that is permanently formed on an upper surface of the body along the GSL.

Figure 3:
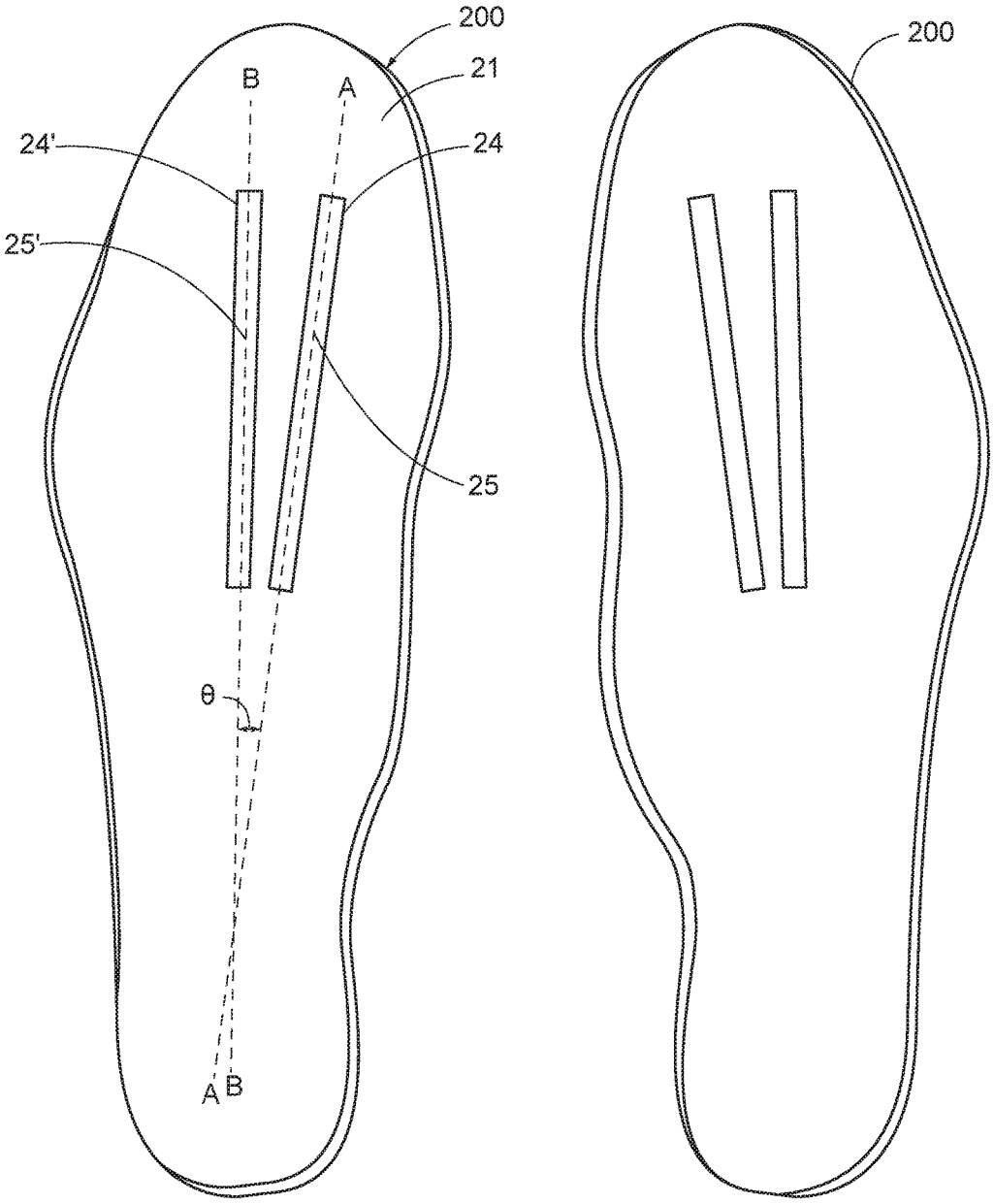
FIG. 3 shows a top elevation view of a pair of shoe inserts in accordance with another embodiment of the disclosure.

FIG. 3 shows another pair of inserts 200, which are the same as the inserts 100 described above, except that the inserts 200 define a second channel 24' in addition to a first channel 24. The reference numbers in FIG. 3 correspond to those in FIGS. 1 and 2 except that they are increased by "20". Also, the second channel 24' may optionally hold a second linear member 25', which may be removable. The second channel 24' and the second linear member 25' may have the same features and dimensions as described above, respectively, as channel 4 and linear member 5. The insert 200 may also have a hole and insert in the heel area, which may be the same as the hole 2 and 3 described above for insert 100. The second channel 24' is located laterally of the first channel 24, and the second channel 24' extends proximally from at or adjacent a third toe area of the body 21. In the example shown in FIG. 3, the second channel 24' extends from a first end just proximal of the third toe area to a second end at about midsole. The second channel 24' extends in a straight line along an axis B-B that is not parallel to the axis A-A along which the first channel 24 extends. In the example shown in FIG. 3, the angle between the two channels is about 6 degrees, but may be in the range of 2 to 10 degrees.

It will be appreciated that the axis B-B and axis A-A, if extended in space, intersect with one another. Thus, the second channel 24' triangulates off of the first channel 24, but within the range of motion initiated by the first channel 24. As a result, the second channel 24' and/or the second linear member 25' increases the total surface area of the foot to be stimulated during use of the insert 200, thereby increasing and improving the sensory feedback and improving the training of the foot to extend in a predetermined position relative to the channels 24 and 24' to promote a user's body to improve balance.

There have been described and illustrated herein several embodiments of a shoe insert. While particular embodiments of the invention have been described, it is not intended that the invention be limited thereto, as it is intended that the invention be as broad in scope as the art will allow and that the specification be read likewise. Thus, while particular materials have been disclosed, it will be appreciated that other materials having the same properties may be used as well. Also, while straight linear channels and linear members are preferred, it will be recognized that curvilinear channels and curvilinear members can similarly be used. It will therefore be appreciated by those skilled in the art that yet other modifications could be made to the provided invention without deviating from its spirit and scope as claimed.

What is claimed is:

1. A shoe insert comprising:

a body having a perimeter defining a foot-shaped area on an upper side of the body, the foot-shaped area including a first and second toe area and a heel area configured respectively for placement of a first and second toe and a heel of a user, the upper side defining only two sensory feedback structures including a first sensory feedback structure extending along a first axis from a space between the first and second toe areas and the heel area, and defining a second sensory feedback structure located laterally of the first sensory feedback structure, wherein the first sensory feedback structure includes a first channel, and the second sensory feedback structure includes a second channel, wherein the second channel extends along a second axis that intersects with the first axis, wherein the first and second channels extend distally from a midsole area, and wherein the first sensory feedback structure includes a first elongated member disposed in the first channel and protruding above a surface of the upper side of the body, and the second feedback structure includes a second elongated member disposed in the second channel and protruding above a surface of the upper side of the body.

2. The shoe insert according to claim 1, wherein:

the second channel extends at an angle between 1 and 15 degrees relative to the first channel.

3. The shoe insert according to claim 1, wherein:

the first channel extends from the space between the first and second toe areas to the midsole area, and the second channel extends from a third toe area to the midsole area.

4. The shoe insert according to claim 1, wherein:

the first elongated member and the second elongated member are resilient and compressible.

5. The shoe insert according to claim 1, wherein:

at least one of the first and second elongated members is removably coupled to the body.

6. A shoe insert kit comprising:

a body having a perimeter defining a foot-shaped area on an upper side of the body, the foot-shaped area including a first and second toe area and a heel area configured respectively for placement of a first and second toe and a heel of a user, the upper side defining only two sensory feedback structures including a first sensory feedback structure extending along a first axis from a space between the first and second toe areas and the heel area, and defining a second sensory feedback structure located laterally of the first sensory feedback structure, wherein the first sensory feedback structure includes a first channel, and the second sensory feedback structure includes a second channel, wherein the second channel extends along a second axis that intersects with the first axis, wherein the first and second channels extend distally from a midsole area; and a first sensory feedback structure including a first elongated member disposable in the first channel and protruding above a surface of the upper side of the body; and a second feedback structure including a second elongated member disposable in the second channel and protruding above a surface of the upper side of the body.

7. The shoe insert kit according to claim 6, wherein:

the first channel extends along a gravitational stress line extending along an axis from a space between a first toe area and a second toe area to the heel area.

8. The shoe insert kit according to claim 7, wherein:

the body defines a hole in the heel area, and the kit further comprises at least one heel insert configured for insertion in the hole.

9. The shoe insert kit according to claim 6, wherein:

the kit includes a symmetrical pair of bodies for left and right feet of a user.

* * * * *